United States Patent [19]

Rosander et al.

[11] 4,123,720

[45] Oct. 31, 1978

[54] METHOD AND APPARATUS FOR COMPENSATON OF EFFECTS OF MISALIGNMENT BETWEEN DEFLECTING MAGNETIC FIELDS AND A LINEAR ACCELERATOR IN A RACE TRACK MICROTRON

[76] Inventors: Staffan B. F. S. J. Rosander, Skiftesvägen 98; Miroslav Sedlacek, Marknadsvägen 99, both of Taby; Olle S. V. Wernholm, Ralambsvägen 21, Stockholm, all of Sweden

[21] Appl. No.: 802,863

[22] Filed: Jun. 2, 1977

[30] Foreign Application Priority Data

Jun. 3, 1976 [SE] Sweden ..... 7606321

[51] Int. Cl.[2] ..... H05H 13/00

[52] U.S. Cl. ..... 328/234

[58] Field of Search ..... 328/233, 234, 235, 236, 328/237, 238

[56] References Cited

PUBLICATIONS

Nuclear Instr. 56, (1967) 170–172, Babić et al.

IEEE Trans. on Nuclear Science, vol. NS-22, No. 3, Jun. 1975, pp. 1176–1178.

IEEE Trans. on Nuclear Science, vol. NS-20, No. 3, Jun., 1973, pp. 81–85.

Nuclear Instr. & Methods, 138, (1976), 1–12, Herminghaus et al.

*Primary Examiner*—John Kominski

*Attorney, Agent, or Firm*—Birch, Stewart, Kolasch and Birch

[57] ABSTRACT

A method for compensating the effects of misalignment between deflecting magnetic fields and a linear accelerator in a race track microtron where properly injected and accelerated electrons travel along successive complete orbits numbered in sequence comprising the steps of generating on both sides of the linear accelerator a compensating magnetic field perpendicular to the common plane of the orbits, each field intersecting all complete successive orbits and having a field strength in the regions of the intersections varying stepwise from intersection to intersection, and simultaneously varying the field strength at the intersections while maintaining a linear relationship between the field strength at an intersection and the number of the intersecting complete orbit.

4 Claims, 6 Drawing Figures

METHOD AND APPARATUS FOR COMPENSATON OF EFFECTS OF MISALIGNMENT BETWEEN DEFLECTING MAGNETIC FIELDS AND A LINEAR ACCELERATOR IN A RACE TRACK MICROTRON

FIELD OF INVENTION

This invention relates to race track microtrons. More particularly the invention relates to methods and apparatus for compensation of effects of misalignment between deflecting magnetic fields or between deflecting magnetic fields and linear accelerator in a race track microtron.

BACKGROUND OF THE INVENTION

The theory of the race track microtron is well known to those skilled in the art.

Evidently different parts of a race track microtron may be designed in more or less different ways. Generally, however, a race track microtron comprises a linear accelerator placed between deflecting magnetic fields. The linear accelerator increases the energy of passing electrons and the deflecting magnetic fields cause the electrons to follow successively greater orbits passing trough the linear accelerator a number of times.

The deflecting magnetic fields may be two generally uniform fields each deflecting incoming electrons 180° (see P. M. Lapostolle "Linear Accelerators", North-Holland Publishing Company, Amsterdam 1970, especially page 559).

For various reasons the two deflecting magnetic fields may be made non-uniform instead of uniform (see H. R. Froelich and J. J. Manca "Performance of a multicavity racetrack microtron", IEEE Transactions on Nuclear Science, Vol. NS-22, No. 3, June 1975, pages 1758–1762).

Instead of two deflecting fields, each deflecting incoming electrons 180°, four deflecting fields, each deflecting incoming electrons 90°, may be used (see page 555 of the Lapostolle reference cited above).

In addition to deflecting magnetic fields correction magnetic fields may be used in the vicinity of the deflecting magnetic fields for stabilizing particle orbits in a race track microtron (see H. Babić and M. Sedlacek "A method for stabilizing particle orbits in the race track microtron", Nuclear instruments and methods, Vol. 56, 1967 , pages 170–172 and L. M. Young, "Experience in recirculating electrons through a superconducting linac", IEEE Transactions on Nuclear Science, Vol. NS-20, No. 3, 1973, pages 81–85, especially FIG. 2).

When mounting and assembling at least some prior art race track microtrons, problems might occur with the positioning and orientation of the magnetic field systems in relation to each other and to the linear accelerator. The reason is that inevitable imperfections in the magnetic systems from their manufacture and imperfections in the positioning and orientation of the magnetic systems and linear accelerators cause an accumulating error in the position of the orbits, whereby optimum performance of the microtron is difficult or impossible to achieve. This error is difficult to impossible to calculate with accuracy in advance but will appear when the mounted and assembled microtron is run.

One way to overcome this problem is to make the position and/or orientation of at least one magnet system and eventually the linear accelerator turnable during operation of the race track microtron. This, however, is difficult to make with large and heavy microtrons and with such smaller and simpler microtrons where there is a need for turning the entire microtrons due to the field of use of the accelerated electrons. Furthermore an efficient extraction of accelerated electrons are made more difficult and complicated when parts of the microtron is turned during operation.

Another way to overcome the problem is to incorporate in the microtron in the field free space between the deflecting magnet systems a new magnetic system creating a generally uniform magnetic field transverse to the plane of the orbits and having a generally wedge-shaped area of distribution in the plane of the orbits (see. R. Alvinson and M. Eriksson "A design study of a 100 MeV race track microtron/pulse stretcher accelerator system", TRITA-EPP-76-07 and LUSY 7601, Royal Institute of Technology, Stockholm 1976, especially pages 6, 29 and 35–36).

A third way to overcome the problem would be to incorporate in the microtron in the field free space between the deflecting magnet systems extra focusing devices such as quadrupole magnets and/or deflecting devices such as dipole magnets each affecting the straight parts of one or a few orbits or the common part of all orbits (see P. Axel et al., "Microtron using a superconducting electron linac", IEEE Transactions on Nuclear Science, Vol. NS-22, No. 3, June 1975, pages 1176–1178 and H. Herminghaus et al., "The design of a cascaded 800 MeV normal conducting C.W. race track microtron", Nuclear instruments and methods, Vol. 138, 1976, pages 1–12, especially FIGS. 8–10 with corresponding text). This way would be rather complex if good results are to be achieved wanted and will also make efficient extraction of accelerated particles from orbits more difficult or complicated.

SUMMARY OF THE PRESENT INVENTION

One object of the present invention is to provide a method for compensating the effects of misalignment between deflecting magnetic fields and a linear accelerator.

Another object of the present invention is to provide an apparatus for compensating the effects of misalignment between deflecting magnetic fields and a linear accelerator.

According to the present invention the effects of misalignment between deflecting magnetic fields and linear accelerator on position and orentation of the successive complete electron orbits is compensated by magnetic fields on both sides of the linear accelerator intersecting all complete successive orbits. The fields are perpendicular to the plane of the successive complete orbits and the strength varies substantially stepwise from intersection to intersection. After assembling and mounting of the race track microtron, the magnitude and direction of the magnetic fields may be varied while maintaining a linear relationship between the field strength at each intersection and the energy of properly accelerated electrons travelling in the respective intersecting complete successive orbit.

According to an embodiment of the present invention the compensating magnetic fields are generated by magnetic systems on both sides of the linear accelerator. Each magnetic system has a row of magnetic pole teeth on one side of the plane of the successive complete orbits and a corresponding row of magnetic pole teeth on the opposite side of the plane of complete successive electron orbits. The pole teeth of each magnetic system have positions and orientations such that each complete successive orbit passes through the space between the facing fronts of a pair of teeth. Each magnetic system has a coil wound to encircle teeth in one row and a coil wound to encircle teeth in the opposite row. The turns of each coil are wound to encircle different teeth and a different number of teeth such that a current through all turns of a coil generates a magnetic field in the space between the pairs of opposing teeth, the field strength and/or direction of which varies from pair to pair and is linearly related to the energy of properly accelerated electrons travelling along the orbits between the respective pair of teeth. The microtron comprises means for generating currents flowing through the coils and means for controlling the magnitude and direction of such currents.

An advantage of the present invention is that the field strength at all intersections may be varied simultaneously merely by controlling one or a few currents.

According to a preferred embodiment of the present invention the compensating magnetic fields are generated at or in the vicinity of the facing fronts of the deflecting magnetic fields.

Further objects and advantages of the present invention will be evident from the detailed description of the invention.

THE DRAWINGS

Figure 3:
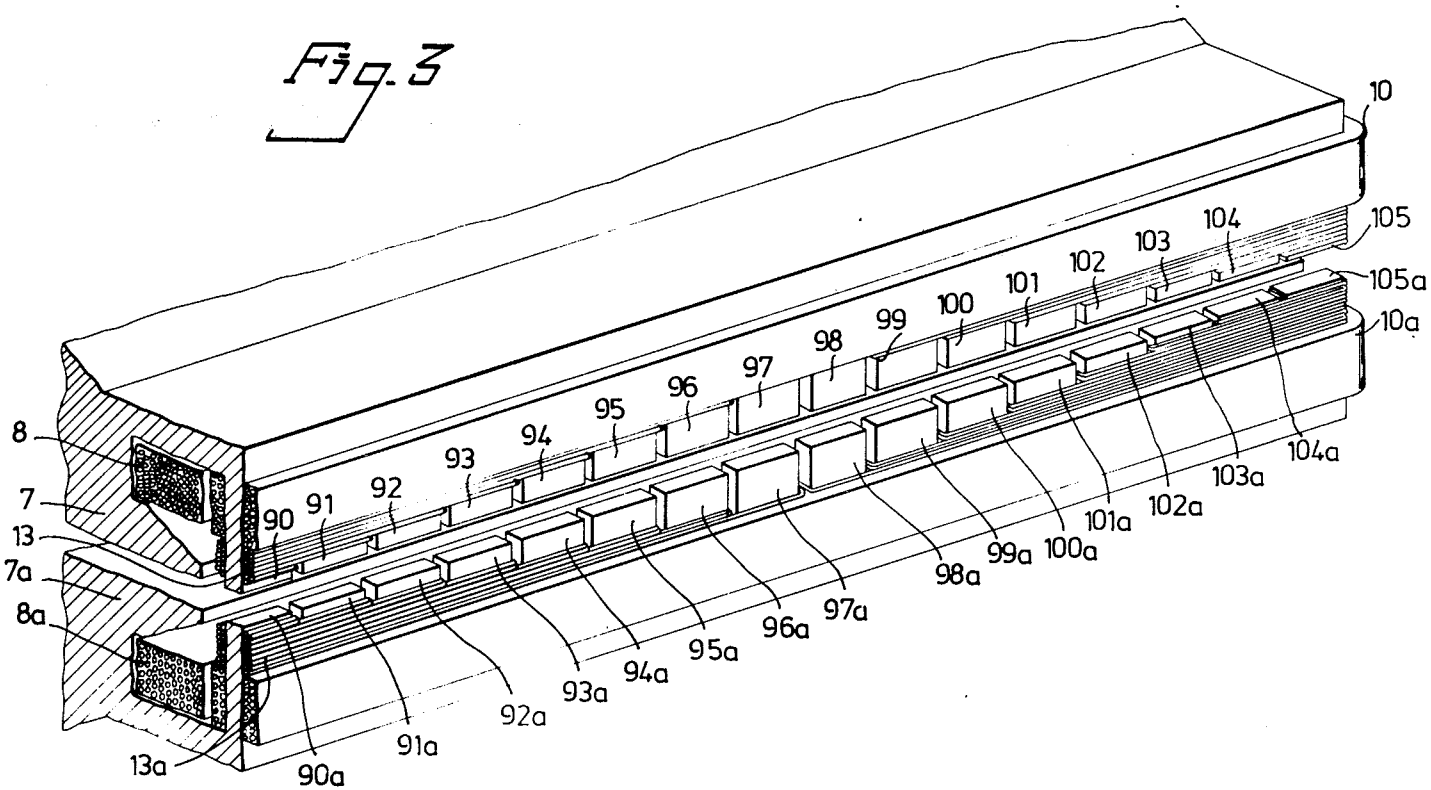
FIG. 3 is a view of a magnetic system partially in section for generating a deflecting magnetic field and a compensating magnetic field according to the present invention.
Figure 5A:
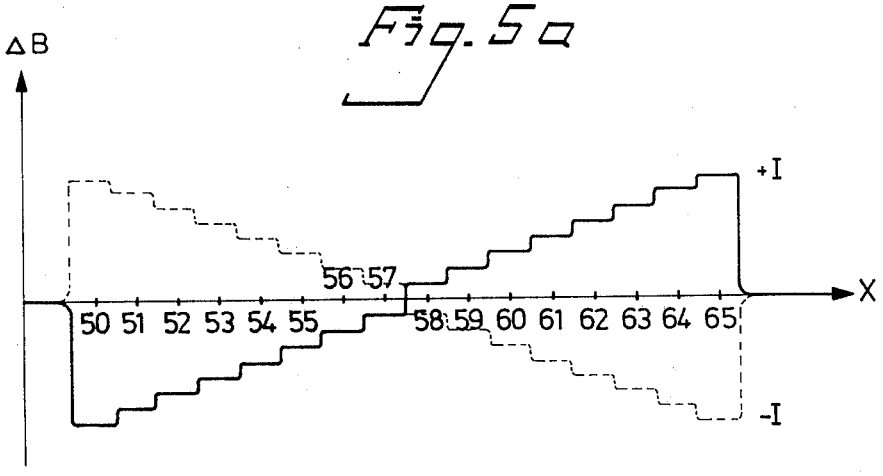

FIG. 5*a* illustrates the field strength and direction generated by a current through coil 13 or 13*a* in a magnet system according to FIG. 3.

Figure 5B:
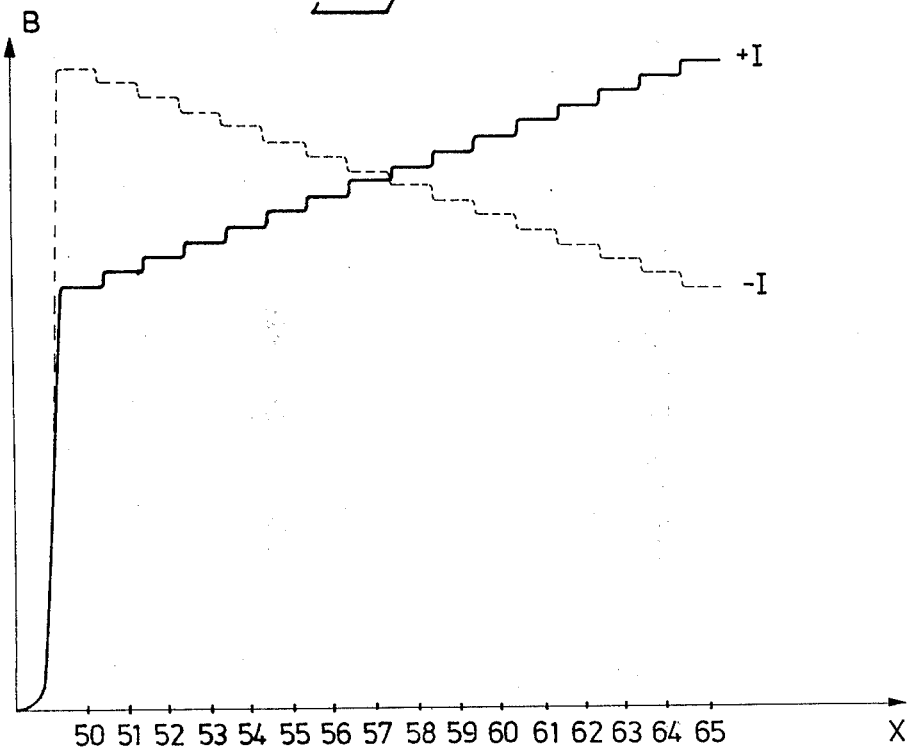

FIG. 5*b* illustrates the combined field generated by a current through coil 10 and a current through 13 and/or a current through coil 10*a* and a current through coil 13*a*.

DETAILED DESCRIPTION

Figure 1:
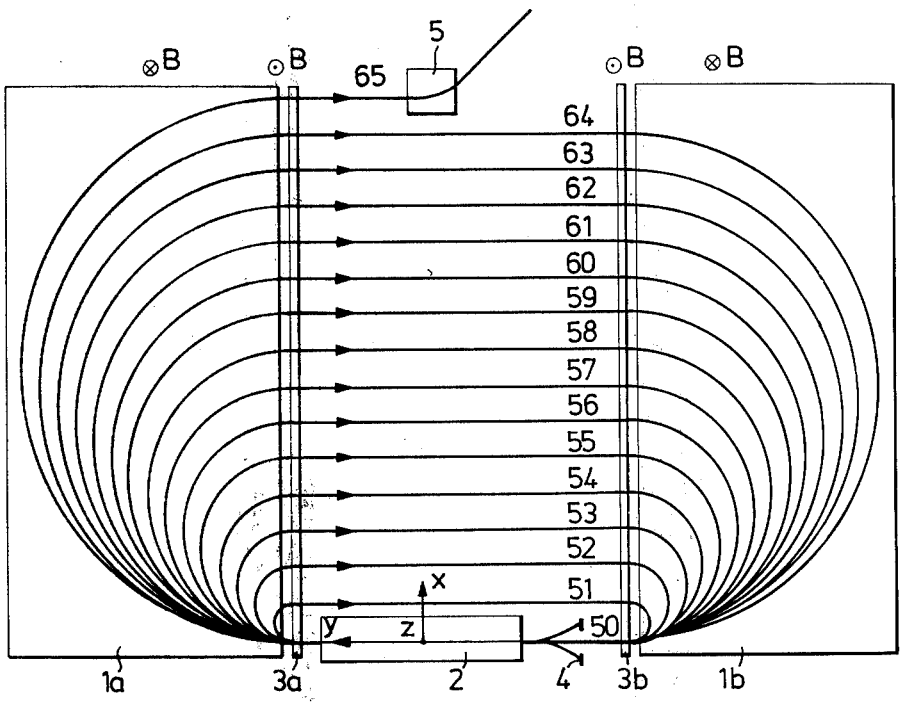
FIG. 1 is a simplified block diagram illustrating the basic principles of a race track microtron.

Illustrated in FIG. 1 are two deflecting magnetic fields 1*a* and 1*b* at a distance from each other. The fields are substantially identical with a uniform field strength of between 0.45 to 0.80 T. Each deflecting field deflects incoming electrons substantially 180°.

Between the deflecting fields, a linear accelerator 2 is positioned. The linear accelerator may be of the general type described in P. M. Lapostolle, Linear Accelerators, North Holland publishing company, Amsterdam 1970, pages 601–616 and the article by H. R. Froelich and J. J. Manca cited above. The design and performance of linear accelerators for microtrons are well known to those skilled in the art and form no part of the present invention. A detailed description of the linear accelerator used is, therefore, considered not necessary.

Illustrated in FIG. 1 are also two magnetic correction fields 3*a* and 3*b*. They are situated close to the facing fronts of the deflecting magnetic fields and directed contrarily to the deflecting fields. The field strength of the correction fields is substantially uniform and between 0.1 and 0.14 T.

Indicated in FIG. 1 is also an annular cathode electron gun 4 for injection of electrons into the microtron. It may be of the general type described by J. J. Manca et al., Annular-cathode electron gun for in-line injection in a race track microtron. Review of Science Instruments, Vol. 47, No. 9, September 1976, page 1148–1152. Alternatively, other means for introducing electrons into orbits in the microtron may be used, see the references cited above and U.S. Pat. No. 3,349,335. Since the means used for introducing the electrons form no part of the present invention, such means will not be described in detail.

The block 5 in FIG. 1 illustrates means for extraction of accelerated electrons from the microtron. Those means may be of different kinds well known to those skilled in the art. For instance, they may be of the same general type as shown in one of the references cited above. Furthermore, the means for extraction of accelerated electrons form no part of the present invention. A detailed description of such means is therefore considered not necessary.

The theory of the race track microtron is well known to those skilled in the art. For an explanation of the present invention it is first assumed that the microtron illustrated in FIG. 1 has perfectly uniform magnetic fields and that the magnetic fields and the linear accelerator are perfectly aligned.

Electrons injected into the microtron and passing through the linear accelerator in the left direction will be accelerated an amount depending on some known characteristics of the microtron. Electrons accelerated once by the linear accelerator and entering the fields 3*a* and 1*a* will be deflected 180° along semi-circles, the diameter of which depends on the energy of the electrons and the strength of the fields.

They will leave the fields 1*a* and 3*a* and travel to the fields 3*b* and 1*b* along substantially straight and parallel paths. After entering the fields 3*b* and 1*b* they will be deflected 180° along semi-circles the diameters of which correspond to those in field 1*a*. Accordingly, the electrons accelerated once by the linear accelerator will leave the fields 1*b* and 3*b* and travel toward the annular cathode electron gun and the linear accelerator. Only electrons meeting certain requirements will travel through the annular electron gun and through the linear accelerator and be accelerated a second time by the linear accelerator. Such electrons will again be deflected along semi-circles by the fields 3*a* and 1*a* and travel along substantially straight and parallel paths to the fields 3*b* and 1*b*, where they will again be deflected along semi-circles. They will again leave the fields 1*b* and 3*b* towards the annular electron gun and the linear accelerator. Of the electrons accelerated twice by the linear accelerator, only those meeting certain requirements will travel through the electron gun and through the linear accelerator and be accelerated a third time by the linear accelerator. It follows from repetition of the discussion above that some electrons will pass through the accelerator and be accelerated a fourth time, a fifth time etc. In this application, the word "properly" will be used to indicate that some or all requirements for repeated acceleration are met. Thus "electrons properly injected" means that the electrons meet the requirements on the injection while "electrons properly accelerated" means that the electrons when passing through the linear accelerator meet the requirements for being substantially accelerated during the passage through the linear accelerator.

In the present application "complete orbit" means the path of a properly injected electron from and including travel through the linear accelerator to but excluding the succeeding travel through the linear accelerator. According to the theory of the race track microtron electrons properly injected into the microtron and properly accelerated by the linear accelerator will travel along successive complete orbits. Normally and in the present application the orbits are given numbers in sequence. Thus the first orbit includes the first passage through the linear accelerator and the n:th orbit includes the n:th passage through the linear accelerator.

In the ideal race track microtron all complete orbits have a substantially straight and common path labelled 50 in FIG. 1. The remaining different parts of the first, second, third etc. complete orbits are labelled 51, 52, 53 etc. in FIG. 1. These remaining parts lie in a common plane through the common path 50. Since electrons in the n:th complete orbit have been properly accelerated n times by the linear accelerator, the diameter of the semi-circles of the n:th orbit is greater than those of the n-1:th complete orbit.

Figure 2:
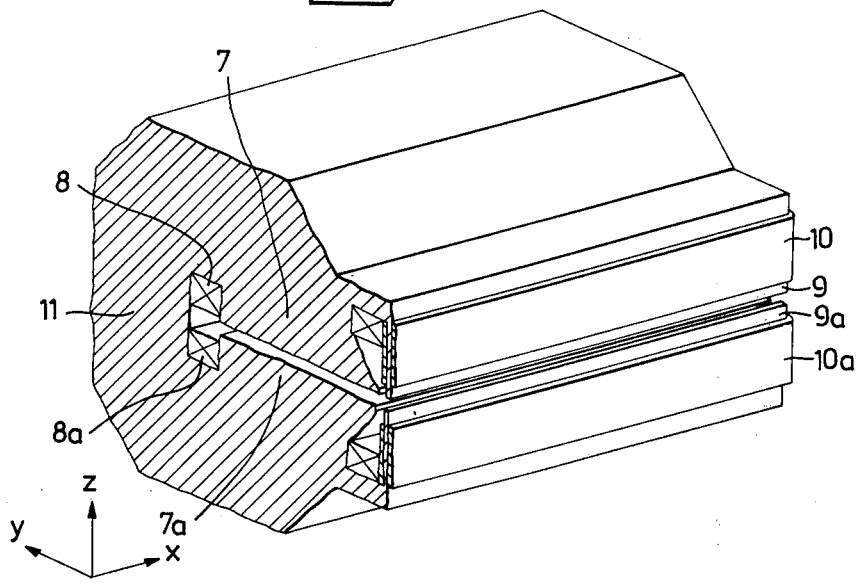
FIG. 2 is a view of a magnetic system partially in section for generating a deflecting magnetic field 1*a* and a correcting magnetic field 3*a* in a race track microtron according to FIG. 1.

FIG. 2 illustrates partly in section a magnet system for generating the deflecting magnetic field 1*a* and the magnetic correction field 3*a*. The deflecting magnetic field 1*a* is generated between the polepieces 7 and 7*a* by currents through coils 8 and 8*a*. Each coil has about 40 turns and the currents used are from about 100 A to about 170 A.

The magnetic correction field 3*a* is generated between the pole pieces 9 and 9*a* by currents through coils 10 and 10*a*. Each coil has about 130 turns and the currents used are from about 5 A to about 10 A.

Although FIG. 2 shows the pole pieces 7, 7*a* and 10, 10*a* to form part of a magnet 11 made in one piece; it should be understood that this is only for reasons of clarity. Normally the magnet 11 is built up by several sheets of magnetic metal or alloy joined together by appropriate means. This, however, is well known to those skilled in the art and does not form part of the present invention. A detailed description of how the magnet with pole pieces is manufactured is therefore considered not necessary.

The overall size of the magnet 11 in FIG. 2 with pole pieces but without coils is 550 mm in the *x*-direction, 510 mm in the *y*-direction and 430 mm in the *z*-direction.

For generation of the magnetic fields 1*b* and 3*b* in FIG. 1 the race track microtron has a magnetic system substantially identical with the one according to FIG. 2.

As far as the present invention is concerned, a race track microtron according to FIGS. 1 and 2 may be considered as prior art.

FIG. 3 illustrates partially in section part of a magnetic system for generation of a deflecting field and a compensating magnetic field according to the present invention. The general shape of the magnet 11 with pole pieces 7 and 7*a* and coils 8, 8*a*, 10 and 10*a* is substantially the same as that of FIG. 2. However, the uniform pole pieces 9 and 9*a* in FIG. 2 have been split up into rows of teeth 90, 90*a*, 91 and 91*a* etc. Each tooth is about 30 mm long in the *x*-direction and about 10 mm in the *y*-direction. The distance between adjacent teeth is about 3 mm.

The number and position of the teeth are determined by the estimated number and positions of complete electron orbits in the race track microtron. There is one row of teeth 90, 91, 92 etc. on one side of the common plane of the complete orbits and one row of teeth 90*a*, 91*a*, 92*a* etc. on the opposite side of the common plane. Each tooth in one row has one and only one corresponding tooth in the other row. Corresponding teeth have facing fronts substantially parallel to the common plane and are symmetrically positioned in relation to the estimated position of a straight part of one complete orbit. There is one pair of corresponding teeth for each straight part unique for one of the succeeding complete orbits and one pair of corresponding teeth for the straight part 50 common to all of the succeeding complete orbits. Thus electrons in the common straight part 50 of all orbits are estimated to pass between the teeth 90 and 90*a* crossing the magnetic field between the teeth 90 and 90*a* substantially in the center of the space between those teeth. Electrons in the straight part unique for the first orbit 51 are estimated to pass between teeth 91 and 91*a* crossing the magnetic field between the teeth 91 and 91*a* substantially in the center of the space between those teeth. Electrons in the straight part unique for the second orbit are consequently estimated to pass between the teeth 92 and 92*a* in the middle of the space between those teeth. In a prototype manufactured for a designed maximum of 15 complete orbits there are 16 pairs of opposite teeth.

A coil 13 is wound around the teeth 90, 91, 92 etc. and a coil 13*a* is wound around the teeth 90*a*, 91*a*, 92*a* etc. All turns of each coil are passed by the same current but all turns of each coil do not encircle all of the teeth 90, 91 etc. respectively all of the teeth 90*a*, 91*a* etc. A first turn of the coil 13 encircles all of the teeth 90, 91, 92, 93, 94, 95, 96 and 97. A second and third turn of coil 13 encircles all of the teeth 90, 91, 92, 93, 94, 95 and 96 but not 97. A fourth and fifth turn of coil 13 encircles all of the teeth 90, 91, 92, 93, 94 and 95 but not teeth 96 or 97. A sixth and seventh turn encircles all of the teeth 90–94 but none of the teeth 95–97. An eighth and ninth turn encircles all of the teeth 90–93 but none of the teeth 94–97. A tenth and eleventh turn encircles the teeth 90, 91 and 92 but none of the teeth 93–97. A twelfth and thirteenth turn encircles only the two teeth 90 and 91. A fourteenth and fifteenth turn encircles only the tooth 90. The direction of winding of these fifteen turns is such that the common current in all turns cooperate to create a magnetic field in the *z*-direction or contrary to the *z*-direction.

A sixteenth turn of the coil 13 encircles all of the teeth 98, 99, 100, 101, 102, 103, 104 and 105 but none of the teeth 90–97. A seventeenth and eighteenth turn of the coil 13 encircles all of the teeth 99, 100, 101, 102, 103, 104 and 105 but none of the teeth 90–98. A nineteenth and twentieth turn of the coil 13 encircles all of the teeth 100 to 105 but none of the turns 90–99. A twenty-first and twenty-second turn of coil 13 encircles all of the teeth 101 to 105 but none of the turns 90–100. A twenty-third and twenty-fourth turn encircles all of the teeth 102 to 105 but none of the turns 90–101. A twenty-fifth and twenty-sixth turn encircles all of the teeth 103 to 105 but none of the turns 90–102.

A twenty-seventh and twenty-eighth turn encircles only the teeth 104 and 105. Finally a twentyninth and thirtieth turn encircles only tooth 105. The direction of winding of the turns 16 to 30 is such that the common current in all those turns cooperate to create a magnetic field opposite to the field created by the same current in the turns 1 to 15. Thus the one and only current through all of the turns 1 to 30 gives a contribution to the total magnetic field between the teeth 90 to 105 and the opposite teeth 90*a* to 105*a* the size and direction of which varies from tooth to tooth. However, the difference between the contribution to the fields between adjacent pairs is substantially the same irrespective of tooth number provided the magnetic material is not in a saturated state. The reason for this is that all adjacent teeth except 97 and 98 are encircled by a number of turns differing by 2. The teeth 97 and 98 are encircled by the same number of turns but the direction of winding is opposite. One way of expressing this would be to say that the common current through all turns of coil 13 gives a contribution to the field between the pole pieces the strength of which has the general shape of a staircase, where the size of all steps may be varied by varying only one current.

The turns of the coil 13*a* are wound in a way corresponding to the turns of coil 13. Thus a first turn encircles all of the teeth 90*a* to 97*a* but none of the teeth 98*a* to 105*a* while a fourteenth and fifteenth turn encircles only tooth 90*a*. A sixteenth turn encircles all of the teeth 98*a* to 105*a* but none of the teeth 90*a* to 97*a* while a twenty-ninth turn and a thirtieth turn encircles only one tooth 105*a*. The turns 1 to 15 of coil 13*a* are wound in a direction making the common current through them to cooperate in creating a magnetic field in the *z*-direction or opposite the *z*-direction. The turns 16 to 30 of coil 13*a* are also wound in a direction making the one and only current through those turns to cooperate in creating a magnetic field in the *z*-direction or opposite in the *z*-direction. However, the turns 16–30 of coil 13*a* has a direction of winding opposite to that of turns 1–15. Thus the common current through all turns of coil 13*a* gives a contribution to the total field between the pole pieces having a general staircase-shaped magnitude provided the magnetic material of the poles is not saturated.

Figure 4:
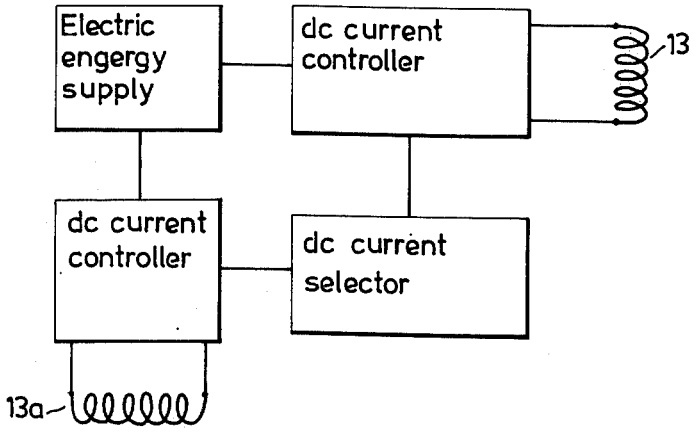
FIG. 4 is a block diagram of means for generating and controlling currents through coils 13 and 13*a* in a magnetic system according to FIG. 3.

The same current may flow through both coils 13 and 13*a*. Alternatively different currents may flow through the coils. In a manufactured prototype, currents up to between 5 and 10*a* have been used. It is preferred that the means used for generating the current is able to switch the direction of current generated. Means for generating and regulating currents from 0 to 5–10 A through a coil is well known to those skilled in the art. Furthermore, the design of such means form no part of the present invention. A detailed description of such means is therefore considered not necessary. However, a block diagram of means for generating said controlling current through two coils is illustrated in FIG. 4. The energy supply may be a common AC net from power station or a battery dc supply. The dc current selector includes means for generating signals indicative of desired direction and magnitude for currents through coils 13 and 13*a*. The dc current controllers include means for generating dc currents of desired direction and magnitude through coils 13 and 13*a* in response to signals from dc current selector. If the same current is to flow through coils 13 and 13*a* the two coils may be series connected to one of the dc current controllers instead as shown in FIG. 4.

FIG. 5*a* is a graph illustrating the contribution to the total field between the teeth generated by a current of absolute magnitude I through the coils 13 and 13*a*. The continuous curve labelled +I illustrates the contribution when the current has a certain direction and the interrupted curve labelled −I illustrates the contribution when the current has the opposite direction. It should be noted that FIG. 5*a* is made somewhat diagrammatical for reasons of clarity. On the *x*-axis are the calculated positions of orbits indicated with reference numerals 50, 51, 52 etc. As far as the space between the teeth is concerned, the general shape of the contribution may be expressed as staircase-shaped.

FIG. 5*b* is a graph illustrating the compensating magnetic field between the teeth 90, 90*a*, 91, 91*a* etc. generated by currents through coils 10, 10*a*, 13 and 13*a*. As in FIG. 5*b* the continuous curve labelled +I illustrates the field when a current I flows through 13 and 13*a* in one direction while the interrupted curve labelled −I, illustrates the field when a current of same absolute magnitude I flows through 13 and 13*a* in the opposite direction.

When previously discussing the race track microtron according to FIG. 1, it was assumed that there were no imperfections in the fields and that the fields were perfectly positioned and oriented in relation to each other and the linear accelerator. In practice these conditions are normally not fully met. Normally even careful assembling and mounting of a race track microtron results in some misalignment between fields and/or accelerator. Normally small imperfections in the fields are also very difficult to avoid.

Ideally the fronts of fields 1*a* and 1*b* should be parallel and perpendicular to the axis of the linear accelerator. Suppose there is a very small misalignment of the field 1*a* so that the front of said field deviates a small angle $\alpha$ from said parallel and perpendicular position in relation to the field 1*b* and the axis of the linear accelerator respectively. Then electrons injected into the first orbit from the annular electron gun 4 and accelerated once by the linear accelerator 2 will theoretically not enter the field 1*a* perpendicular to its front but with an angle deviating $\alpha$ from being perpendicular. When said electrons are deflected by the field 1*a* they will theoretically leave the field at an angle also deviating $\alpha$ from being perpendicular to the front of the field 1*a*. Since the front itself deviates from being perpendicular to the axis of the linear accelerator the electrons in the first orbit will leave field 1*a* at an angle deviating $2\alpha$ from being parallel to the axis of the linear accelerator. Provided the field 1*b* is perfectly aligned and ideally uniform, the electrons in the first orbit will leave the field 1*b* at an angle deviating $2\alpha$ from being parallel to the axis of the linear accelerator. Due to the straight part of the first orbit between fields 1*a*, and 1*b* not only the direction of electrons leaving field 1*b* will deviate from the ideal one, but also their position in the *x*-axis direction will differ from the theoretically calculated and indicated one. Provided the angle $\alpha$ is small enough the electrons finishing the first orbit will nevertheless pass through the annular electron gun and through the linear accelerator, whereby they are accelerated a second time. Provided the linear accelerator does not substantially change the direction of electrons having passed it twice such electrons, now being in the second orbit, will enter the field 1*a* at an angle deviating $3\alpha$ from being perpendicular to the front of the field. Consequently, such electrons in the second orbit will leave the field 1*a* at an angle also deviating $3\alpha$ from being perpendicular to the front of the field. Thus the straight part of the second orbit between fields 1*a* and 1*b* will form an angle of $4\alpha$ with the axis of the linear accelerator. Thus a small misalignment only in the field 1*a* causes differences between actual orbit positions and theoretically calculated orbit positions, the difference being greater for the second orbit than for the first orbit. If the discussion above is repeated it is found that the difference between the actual position of the third orbit and the theoretically calculated ideal position of the third orbit is greater than the corresponding difference for the second orbit. Accordingly, as long as the conditions stated above are substantially met the difference will continue to increase with the increasing orbit number. However the hole of the annular electron gun and the accepting hole or zone of the linear accelerator is limited. Thus theoretically the electrons after travelling a certain number of orbits will have a position and direction differing so much from the ideal and theoretical common straight part of all orbits that they will not pass through the annular electron gun or will not pass through the linear accelerator. After how many orbits this will happen depends on the angle $\alpha$, the electron gun and the linear accelerator.

It can be theoretically shown that the effect of the above assumed misalignment may be at least partially compensated for by magnetic fields affecting the electrons in the orbits. Theoretical calculations indicate that such fields coinciding with or in the vicinity of the fields 3*a* and 3*b* should, at least in the regions of intersection with electron orbits, have a field strength depending linearly on the energy of the electrons in respective orbit. Theoretically the energy increases the same amount from orbit to orbit. Thus theoretically the field strength should increase or decrease the same amount from orbit to orbit in the *x*-axis direction. Returning to FIG. 5*a* and 5*b* it is seen that the magnetic field generated by the magnetic system according to FIG. 3 meets the theoretical requirement for compensation of misalignment.

The method and means according to FIGS. 3 and 4 offers the advantage of easy compensation of misalignment after mounting and assembling and during operation of the race track microtron. Normally there is one magnet system with teeth and coils 13, 13*a* according to FIG. 3 to the left of the linear accelerator and a structurally substantially identical magnet system to the right of the linear accelerator. A first current is made to flow through coils 13 and 13*a* of the left system and a second current is made to flow through the coils 13 and 13*a* of the right system. The direction and magnitude of the two currents are independently adjustable. With such means the effect of misalignment on all complete successive orbits may be controlled simultaneously by merely appropriate control of two currents.

In practice all conditions set forth above are not completely met. Further, both field 1*a* and 1*b* may be misaligned in relation to the linear accelerator. However, in a manufactured prototype the effect of misalignment has been substantially reduced with pole teeth and windings according to FIG. 3 resulting in a considerable improvement in the performance of a race track microtron. It is therefore believed that the present invention provides a method and means for at least partially compensating the effects of misalignments between deflecting fields and/or linear accelerator in race track microtrons.

Naturally the misalignment discussed above may be of a geometrical nature. That is the effect of a geometrical error in the position and orientation of a perfect magnet system. However, the misalignment may also result from field imperfections in a magnet system geometrically perfectly oriented.

According to FIG. 3 the teeth 90, 90*a*, etc., form an integral part of the means for generation of the correction field and the deflecting field. In some race track microtrons the means for generating the correction fields do not form an integral part of the means for generating the deflecting field, see the article by Young cited above, especially FIG. 2. In such microtrons the teeth 90, 90*a*, etc., with coils 13, 13*a* may form an integral part of the means called active field clamp in the cited article by Young.

There are other ways of winding the coils than described and shown in FIG. 3. According to one embodiment, all turns are wound in the same direction. A first and a second turn of each coil 13, 13*a* encircles all teeth 90, 91 . . . 105 and 90*a*, 91*a* . . . 105, respectively. A third and fourth turn of each coil 13, 13*a* encircles all teeth 91 . . . 105 and 91*a* . . . 105*a*, respectively, but not 90 and 90*a* respectively. A fifth and sixth turn encircles all teeth 92 . . . 105 and 92*a* . . . 105*a*, respectively, but not 90, 91 and 90*a*, 91*a*, respectively. A seventh and eighth turn encircles all teeth 93 . . . 105 and 93*a* . . . 105*a* respectively but not 90 . . . 92 and 90*a* . . . 92*a* respectively. A ninth and tenth turn encircles all of the teeth 94 . . . 105 and 94*a* . . . 105*a*, respectively, etc. Finally a thirty-first and thirty-second turn of each coil 13, 13*a* encircles only tooth 105 and 105*a*, respectively. According to this embodiment, the number of turns encircling adjacent teeth always differs by two, and the number of turns encircling a tooth depends linearly on the number of the tooth. Further, the number of a tooth such as 95 and its opposing tooth such as 95*a* is linearly related to the number of the orbit passing through the space between the pair of opposing teeth. Consequently, the number of turns of each coil influencing electrons in a certain orbit is linearly related to the number of the orbit. From the space between teeth 90 and 90*a* to the space between 105 and 105*a* the magnetic field strength generated by a current through coil 13 and 13*a* is stepwise increased in the *x*-axis direction. The direction of the magnetic field generated depends on the direction of the current. If this field is combined with the correction field generated by coils 10 and 10*a*, the resulting field has almost the same general shape as shown in FIG. 5*b*. However, the space required for this way of winding the coils 13 and 13*a* is greater than the space required for the other way of winding coils 13, 13*a*. Accordingly, the way of winding indicated in FIG. 3 is preferred.

Naturally other more or less different ways of winding coils 13 and 13*a* are possible. For example the number of turns encircling adjacent teeth may always differ by one or always differ by three instead of always differ by two. However, irrespective of the method of winding and number of turns per coil, the magnetic field generated by a current through a coil 13, 13*a* should, in the space between the opposing teeth, always have a field strength and direction linearly related to the energy of properly accelerated electrons in complete orbits intersecting the field between the teeth. This means a field strength generally staircase-shaped in the *x*-axis direction of FIGS. 1 to 3.

Although two coils 13 and 13*a* according to FIG. 3 are preferred, two coils are not absolutely necessary. Alternatively, only one coil 13 encircling teeth 90 . . . 105 or only one coil 13*a* encircling teeth 90*a* . . . 105*a* may be used.

Although it is preferred to have two coils 13, 13*a* wound in the same way, this is not absolutely necessary. Alternatively, it is possible to have one coil 13 wound according to FIG. 3 and one coil 13*a* wound in the other way or vice versa.

Further, it is not necessary to have two substantially identical magnetic systems on opposite sides of the linear accelerator. For example, the coils 13 and 13*a* of the left magnet system may be wound as shown in FIG. 3 while the coils 13 and 13*a* of the right magnet system may be wound in another way.

When the energy of electrons injected into the race track microtron is low, there may be special problems with the first of the successive complete orbits, at least in some race track microtrons. Accordingly, there has been proposed to introduce in the microtron special means for influencing electrons in the first orbit. For this reason as well as others, the turns of coils 13, 13*a* may be wound generally as described above, but with no turns encircling tooth 90 or 90*a*. Then the field from currents through coils 10, 10*a* alone may be used for compensation purposes as far as the first orbit is concerned.

We claim:

1. A method for compensating for the effects of misalignment between deflecting magnetic fields and a linear accelerator in a race track microtron where properly injected and accelerated electrons travel along successive complete orbits numbered in sequence comprising the steps of:

generating on both sides of the linear accelerator a compensating magnetic field perpendicular to the common plane of the orbits, each field intersecting all complete successive orbits and having a field strength in the regions of the intersections varying stepwise from intersection to intersection; and simultaneously varying the field strength at the intersections while maintaining a linear relationship between the field strength at an intersection and the number of the intersecting complete orbit.

2. An apparatus for compensating the effects of misalignment between deflecting magnetic fields and a linear accelerator in a race track microtron where properly injected and accelerated electrons travel along successive complete orbits numbered in sequence, the apparatus comprising:

means for generating on each side of the linear accelerator a compensating magnetic field perpendicular to the common plane of the successive complete orbits, each field intersecting all the complete successive orbits and having a field strength in the regions of the intersections varying stepwise from intersection to intersection; and means for simultaneously varying the field strength at the intersections while maintaining a linear relationship between the field strength at an intersection and the number of the intersecting complete orbit.

3. A race track microtron comprising:

a linear accelerator for accelerating electrons properly passing through it;

deflecting magnetic fields on both sides of the linear accelerator for forming the paths of electrons properly accelerated by the linear accelerator into successive complete orbits through the linear accelerator;

means for generating magnetic compensation fields on both sides of the linear accelerator between the accelerator and the deflecting magnetic fields, each compensation field being perpendicular to the common plane of the complete successive orbits and intersecting all the complete successive orbits; and means for simultaneously varying the field strength of a magnetic compensation field in the regions of the intersections while maintaining a linear relationship between the field strength at an intersection and the number of the intersecting complete orbit.

4. A race track microtron comprising:

a linear accelerator for accelerating properly injected electrons passing through it;

deflecting magnetic fields on both sides of the linear accelerator for causing electrons properly accelerated by the linear accelerator to travel along successive complete orbits numbered in sequence through the linear accelerator;

magnetic systems on both sides of the linear accelerator for generating magnetic compensation fields on both sides of the linear accelerator between the accelerator and the deflecting fields, each magnetic system having a row of magnetic pole teeth on one side of the common plane of the successive complete orbits and a corresponding row of magnetic pole teeth on the opposite side of the common plane, the pole teeth of each magnetic system having a position and orientation such that each complete successive orbit passes through the space between the facing fronts of a pair of teeth, each magnetic system further having a coil wound to encircle teeth in one of the rows and a coil wound to encircle teeth in the opposite row, each coil having turns wound to encircle different teeth and different numbers of teeth such that a current through all turns of a coil generates a magnetic field between the pairs of opposite teeth the field strength and/or direction of which varies stepwise from pair to pair and is linearly related to the number of the complete successive orbit passing through the space between respective pair of teeth; and means for generating currents flowing through the coils and for controlling the magnitude and direction of the currents through the coils.

* * * * *